US005855031A

United States Patent [19]

Swift, Jr.

[11] Patent Number: 5,855,031

[45] Date of Patent: Jan. 5, 1999

[54] CRIB WITH INFANT HAMMOCK

[76] Inventor: Wade Swift, Jr., 1419 Golden Eye Loop NE., Rio Rancho, N. Mex. 87124

[21] Appl. No.: 967,861

[22] Filed: Nov. 12, 1997

[51] Int. Cl.[6] ..... A47D 7/00; A47C 19/00

[52] U.S. Cl. ..... 5/93.1; 5/98.3; 5/655; 5/904

[58] Field of Search ..... 5/93.1, 98.1, 98.3, 5/655, 724, 904, 105, 101, 94, 110–114; 4/572.1

[56] References Cited

U.S. PATENT DOCUMENTS

| | | | |
|---|---|---|---|
| 2,467,890 | 4/1949 | Harvey | 5/98.3 |
| 2,601,111 | 6/1952 | Foster | 5/93.1 |
| 3,837,019 | 9/1974 | Hoff | 5/93.1 |
| 4,823,418 | 4/1989 | Downs | 5/98.3 |
| 4,875,238 | 10/1989 | Solomon et al. | 2/75 |
| 4,941,453 | 7/1990 | Shakas | 5/98.3 |
| 4,972,533 | 11/1990 | Brown | 5/904 |
| 5,014,376 | 5/1991 | Doran et al. | 5/904 |
| 5,016,301 | 5/1991 | Combs | 5/105 |
| 5,274,863 | 1/1994 | Fountain | 5/98.3 |
| 5,406,655 | 4/1995 | Sahlin | 5/655 |
| 5,561,876 | 10/1996 | Petruzella | 5/724 |
| 5,566,407 | 10/1996 | Lien | 5/93.1 |
| 5,640,726 | 6/1997 | Fishner-Rathus | 5/904 |
| 5,664,273 | 9/1997 | Obriot | 5/98.3 |
| 5,699,571 | 12/1997 | Yowell | 5/98.3 |
| 5,722,100 | 3/1998 | Jozwiak | 5/655 |

*Primary Examiner*—Alexander Grosz
*Attorney, Agent, or Firm*—Kenneth L Tolar

[57] ABSTRACT

The present invention relates to an infant hammock comprising a substantially rectangular mesh type panel having a substantially rectangular frame member integral with the panel's peripheral edges. Perpendicularly extending from each corner of the frame member is a support leg for contacting the upper surface of a baby crib and for supporting the fabric panel a predetermined distance thereabove. Disposed on the peripheral edges of the fabric panel is one or more digital micro-chips for selectively emitting soothing tones such as lullabies or similar songs. The frame member components and support legs are detachable allowing the device to be easily disassembled for transport or storage.

7 Claims, 2 Drawing Sheets

CRIB WITH INFANT HAMMOCK

BACKGROUND OF THE INVENTION

The present invention relates to a hammock designed to be used in conjunction with a baby crib so that infants may more safely sleep on their stomachs. Sudden Infant Death Syndrome (SIDS) has been identified as a leading cause of infant deaths especially for those between the ages of 0–1 years. Although the exact cause of Sudden Infant Death Syndrome has not yet been accurately determined, it is believed to be related to infants sleeping on their stomachs. Some theories have suggested that because an infant cannot raise its head, it may not have sufficient access to fresh air when lying on its stomach. Accordingly, many parents are advised to place small babies on their back or side when placing an infant in a crib. However, infants sleeping on their back are at risk for other complications such as choking on their own vomit. The present invention provides a hammock supported by an integral frame that suspends the hammock a short distance above a baby crib mattress. The hammock is constructed of a mesh type material allowing infants to lie on their stomach with little or no risk of suffocation or reduced air flow to the baby's mouth. Furthermore, the hammock has an integral sound producing means which may selectively emit songs, lullabies or similar tones for appeasing an infant.

DESCRIPTION OF THE PRIOR ART

Attempts have been made to address the above described problems using various hammocks or mattresses. However, none of these devices have the unique features and safeguards of the present invetention as will be described in more detail below. For example, U.S. Pat. No. 5,274,863 issued to Fountain relates to a baby's hammock comprising a rectangular or oval frame supporting a fabric hammock portion which is attached to a baby crib's side walls using cords at each corner thereof. The device is unsuitable for the problems associated with a child sleeping on his or her stomach because the fabric hammock portion is non-porous and does not allow air to flow therethrough. Furthermore, the device is attached to the crib using cords which may easily break or become detached.

U.S. Pat. No. 4,941,453 issued to Shakas relates to a hammock attachable to the top of a crib side rails and which has an integrated sonic device for generating audible and vibrational impulses simulating a human heartbeat. The device does not address the above described problems.

U.S. Pat. No. 4,823,418 issued to Downs relates to a birth safety net designed to prevent the dropping of a newborn child as it exits the birth canal. The device comprises a fabric body, five sides, five corners and means for securing each corner to a portion of the birthing chair or birthing bed.

U.S. Pat. No. 5,016,301 issued to Combs relates to an infant rocker cradle comprising a generally rectangular frame having arcuate rocking edges on which a hammock is supported.

U.S. Pat. No. 5,561,876 issued to Petruzella relates to an infant mattress comprising a generally rectangular rigid frame supporting a mesh type material which is placed in a conventional baby crib to replace the standard mattress. Although the device is designed to minimize the potential for SIDS, the device lacks the safeguards and features of the present invention.

U.S. Pat. No. 2,467,890 issued to Harvey relates to a baby hammock with detachable end sections allowing the device to be adjustable and which also has removable pillows therein.

Although many baby hammocks and similar support devices exist, these devices have several drawbacks. The cloth mesh type mattress described above which is designed to address the problems associated with SIDS is designed to be used in lieu of a standard mattress. Accordingly, the infant is suspended several feet above the floor on a thin, tenuous surface which could easily tear or collapse. In such a case, the baby could fall several feet landing on a hard surface resulting in injury or possibly death. The present invention provides a mesh type hammock having an integral frame for suspending the hammock a short distance above the crib mattress. Therefore, should the hammock tear or for whatever reason collapse, the baby would fall only a short distance and would land on a soft flexible surface. Alternatively, the present invention can be used outside of a baby crib as a stand alone device since its support legs are relatively short and the distance between the hammock and the floor would be minimal. Furthermore, the hammock has an integral sound producing means to assist the child in falling asleep while lying thereon.

SUMMARY OF THE INVENTION

The present invention provides an infant hammock designed to primarily be used in conjunction with a standard baby crib and mattress. The device comprises a substantially rectangular panel of mesh like fabric material having four peripheral edges. Integrally adjacent each peripheral edge is an elongated tubular sleeve each with opposing open ends. The sleeves receive a substantially rectangular frame component. Vertically depending from each of the four corners of the frame component is a support leg for supporting the hammock a predetermined distance above a crib mattress. Disposed on one or more of the peripheral sleeves are a plurality of digital sound chips each preprogrammed with a specific lullaby, song or similar soothing tones. A user may selectively play a nursery rhyme or song by simply pressing a button in communication with the sound chip. It is therefore an object of the present invention to provide an infant hammock which is supported a predetermined distance above a crib mattress to provide additional safety.

It is yet another object of the present invention to provide an infant hammock having integrated sound producing means thereon.

It is yet another object of the present invention to provide an infant hammock supported by a frame component which may be easily disassembled.

It is yet another object of the present invention to provide an infant hammock designed to minimize problems which could lead to SIDS, choking or suffocation.

It is yet another object of the present invention to provide an infant hammock that is securely stabilized within a baby crib. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
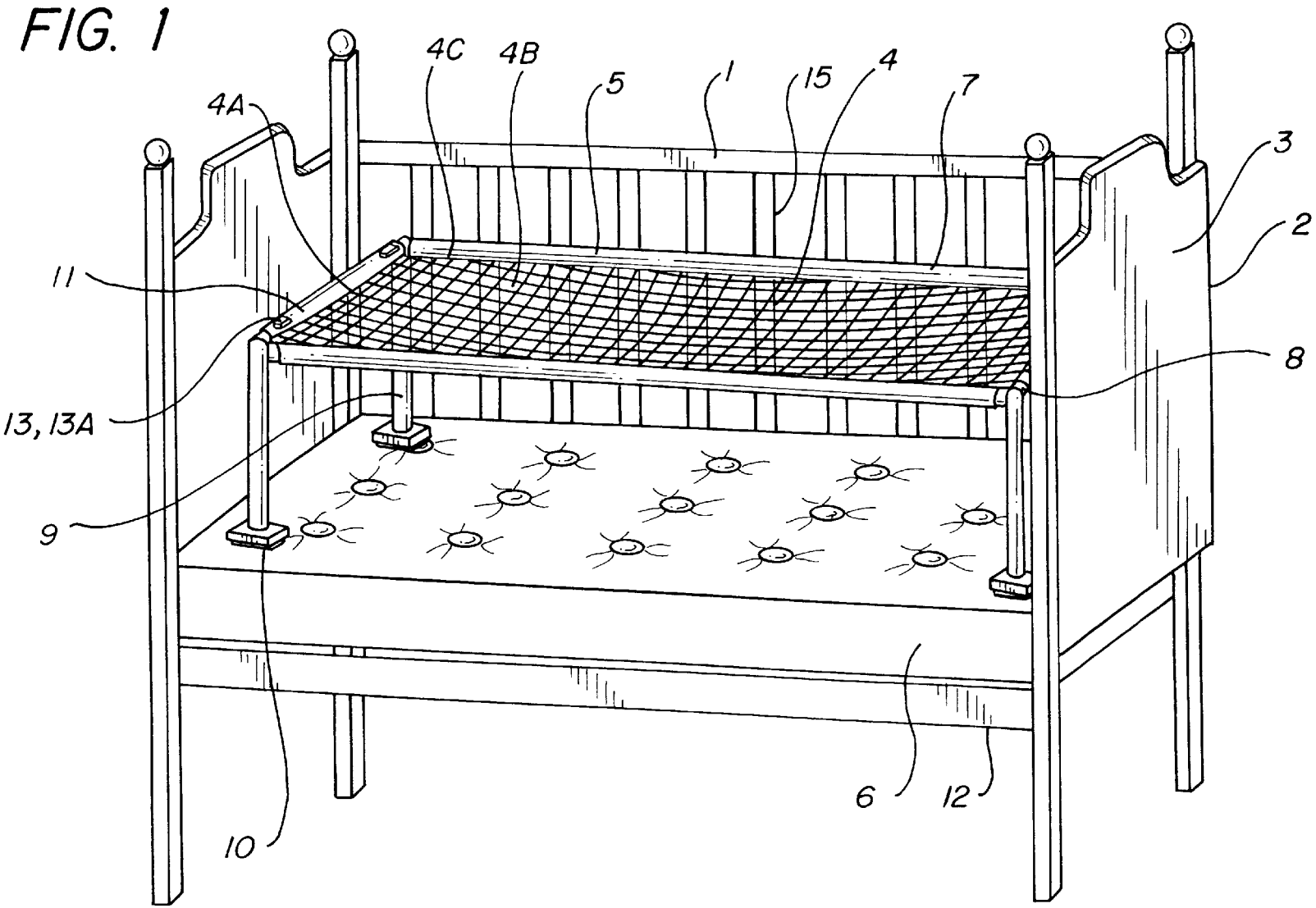
FIG. 1 depicts the inventive device disposed on the upper surface of a crib mattress.
Figure 2:
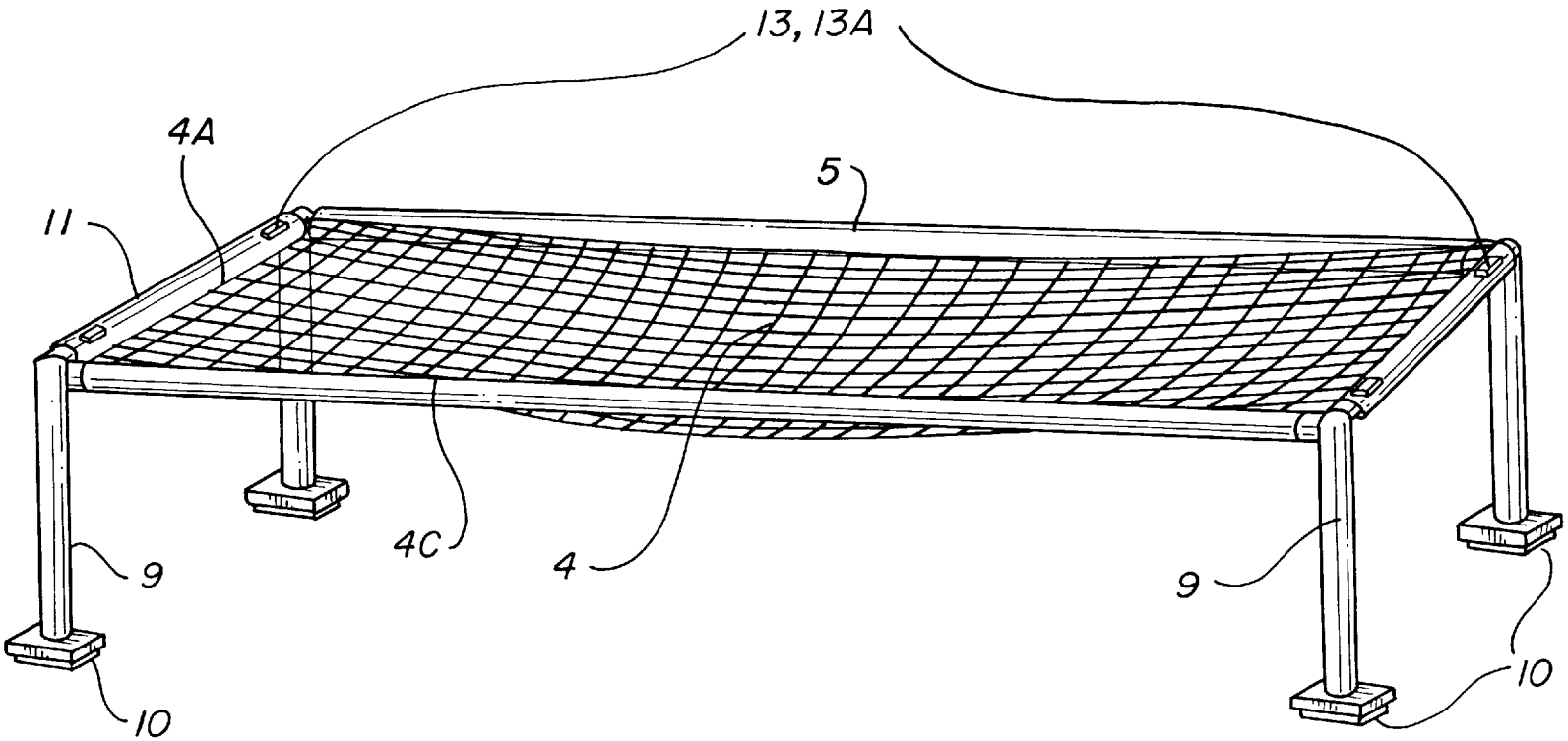
FIG. 2 is a side view of the inventive device.

Referring now to FIGS. 1 through 2, the present invention relates to an infant hammock to be used in conjunction with a standard baby crib 3 having a pair of opposed side rails 1 with a pair of opposed end walls 2 therebetween. The side rails 1 typically comprise a plurality of spaced substantially parallel vertical bars 15 to prevent a child from rolling out of the crib. A standard foam type mattress 6 is generally supported between the end walls 2 and side rails 1 by a frame 12 or similar support means.

The present invention comprises a substantially rectangular hammock 4 made from a mesh like fabric material having an upper surface, a lower surface, two longitudinal 4C and two lateral peripheral edges 4A. The mesh apertures 4B are dimensioned to allow sufficient air flow therethrough. However, the apertures are preferably small enough so that a baby's skin may contact the hammock without resulting in creases or indentions and so that the baby's fingers may not be inserted therethrough. Preferably, the material resembles that of a standard mesh football jersey of the type generally known in the prior art. Integrally adjacent the peripheral edges of the hammock are two longitudinal 5 and two lateral 11 sleeves each of which have two opposed open ends.

The hammock is supported by a frame member comprising two longitudinal side components 7 and two shorter end components 8. The end components 8 are received within the opposing lateral sleeves 11 and the side components 7 are received within the opposing longitudinal sleeves 5. The side 7 and end 8 components are removably interconnected to form a substantially rectangular peripheral support frame having four corners.

A plurality of support legs 9 perpendicularly depend from the frame member each immediately adjacent a corner thereof. Additional support legs 9 may depend from intermediate portions of the frame components to provide additional support. Attached to a distal end of each leg 9 is a padded foot 10 for contacting the upper surface of the crib mattress 6 for providing additional support and stability to the device. Preferably, the frame components 7,8 and support legs 9 are constructed with a lightweight but durable material such as polyvinyl chloride (PVC) or a similar material. The padded foot 10 is preferably dimensioned such that it cannot protrude through adjacent vertical bars on the crib side rails. Such a dimension will ensure that the hammock, frame and support legs remain within the crib at all times.

Disposed on one or more of the peripheral sleeves are one or more pockets each for receiving a preprogrammed digital musical microchip 13 of the type generally known in the prior. The microchip is preferably in communication with a button 13A allowing a user to selectively play any one of a number of various soothing tones such as lullabies, songs, nursery rhymes, etc.

Preferably the frame member and hammock 4 are dimensioned such that when the device is placed in a standard baby crib each longitudinal side component 7 is contiguous with a side rail 1 and each end component 8 is contiguous with an end wall 2 to ensure that the device will not shift or slide. The hammock 4 and integral sleeves 5,11 are dimensioned such that when placed on the support frame the hammock 4 is taut but slightly flexible when a baby is placed thereon. Dimensioning the hammock as such will prevent crevices from forming near the baby's mouth which may interfere with breathing. However, as will be readily apparent to those skilled in the art, the size, shape, materials of construction, color and similar properties of the various components may be varied to suit a particular application or to fit within a particular size baby crib. Furthermore, the frame components and the support legs are detachable to allow the device to be easily disassembled for storage or transport.

There has been shown and described a new and improved baby hammock for suspending an infant a predetermined distance above a standard crib mattress so that an infant may sleep more safely on its stomach. Although there has been shown and described the preferred embodiment of the present invention, it will be readily apparent to those skilled in the art that changes may be made thereto which do not exceed the scope of the appended claims. Accordingly the scope of the invention is only be limited by the following claims.

What is claimed is:

1. In combination with a baby crib having two opposing side rails with a plurality of vertical spaced bars, two opposing end walls perpendicularly disposed between said side rails and a mattress supported a predetermined distance above the floor between said end walls and said side rails, an infant hammock comprising:

a substantially rectangular fabric mesh panel having two longitudinal and two lateral peripheral edges each of said peripheral edges having an elongated tubular sleeve integrally adjacent therewith;

a substantially rectangular frame member having four corners received within said sleeves;

said frame member comprising a pair of longitudinal side components, a pair of end components perpendicularly disposed between said side components and removably attached thereto, said side components received within said sleeves integrally adjacent with said longitudinal peripheral edges and said end components received within said sleeves integrally adjacent said lateral peripheral edges, said frame member being dimensioned such that the end components are immediately adjacent opposing end walls of said crib and said side components are immediately adjacent opposing side rails of said crib to prevent said frame component from shifting horizontally within said crib;

a plurality of support legs extending from said frame member and substantially perpendicular thereto proximal each corner of said frame component for contacting the upper surface of said mattress and for supporting the mesh panel a predetermined distance thereabove wherein each of said support legs has a foot member at a distal end thereof, said foot members being dimensioned such that the foot members cannot protrude through the vertical bars of said side rails.

2. A combination according to claim 1 further comprising:

at least one sound producing means integral with a fabric panel sleeve.

3. A combination according to claim 2 wherein said sound producing means is a preprogrammed digital sound chip.

4. A combination according to claim 1 wherein said mesh panel and said frame member are dimensioned such that the panel is rigid but slightly flexible.

5. A combination according to claim 1 wherein said support legs are removably attached to the corners of said frame member.

6. A combination according to claim 1 further comprising at least one support leg disposed between two corners of said frame member and attached thereto for providing additional support thereto.

7. A combination according to claim 1, wherein the foot members are padded and provide additional stability to said frame member.

* * * * *